United States Patent [19]

Graeser, Jr. et al.

[11] 4,231,041

[45] Oct. 28, 1980

[54] ELECTRICALLY CONDUCTING LEAD TERMINATION APPARATUS FOR A THIN FILM ANTENNA

[75] Inventors: Joseph H. Graeser, Jr., Cortland; Robert J. Adkins, Warren, both of Ohio

[73] Assignee: General Motors Corporation, Detroit, Mich.

[21] Appl. No.: 49,440

[22] Filed: Jun. 18, 1979

[51] Int. Cl.[2] ..... H01Q 1/50

[52] U.S. Cl. ..... 343/767; 343/906; 174/94 R; 219/522

[58] Field of Search ..... 343/704, 711, 712, 713, 343/767, 770, 771, 906; 174/94 R; 219/203, 522, 541, 543; 339/10

[56] References Cited

U.S. PATENT DOCUMENTS

| | | | |
|---|---|---|---|
| 2,908,000 | 10/1959 | Robinson | 343/746 |
| 3,231,664 | 1/1966 | Acton | 174/94 R |
| 3,866,232 | 2/1975 | Weigt | 343/713 |
| 4,063,246 | 12/1977 | Greiser | 343/700 MS |
| 4,141,011 | 2/1979 | Boaz | 343/713 |

*Primary Examiner*—Eli Lieberman

*Attorney, Agent, or Firm*—Robert M. Sigler

[57] ABSTRACT

Apparatus for connecting an electrically conducting antenna lead to a non-solderable, electrically conducting antenna surface includes a strip of electrically conducting solderable tape fixed adhesively to the first paint coating, the lead being soldered to the strip. The strip has a plurality of cutout openings to provide inner edges and additional access to the antenna surface; and a coating of electrically conducting paint over the strip and openings to provide electrical contact between the strip top or edges and the antenna surface and further provide environmental protection for the apparatus.

1 Claim, 1 Drawing Figure

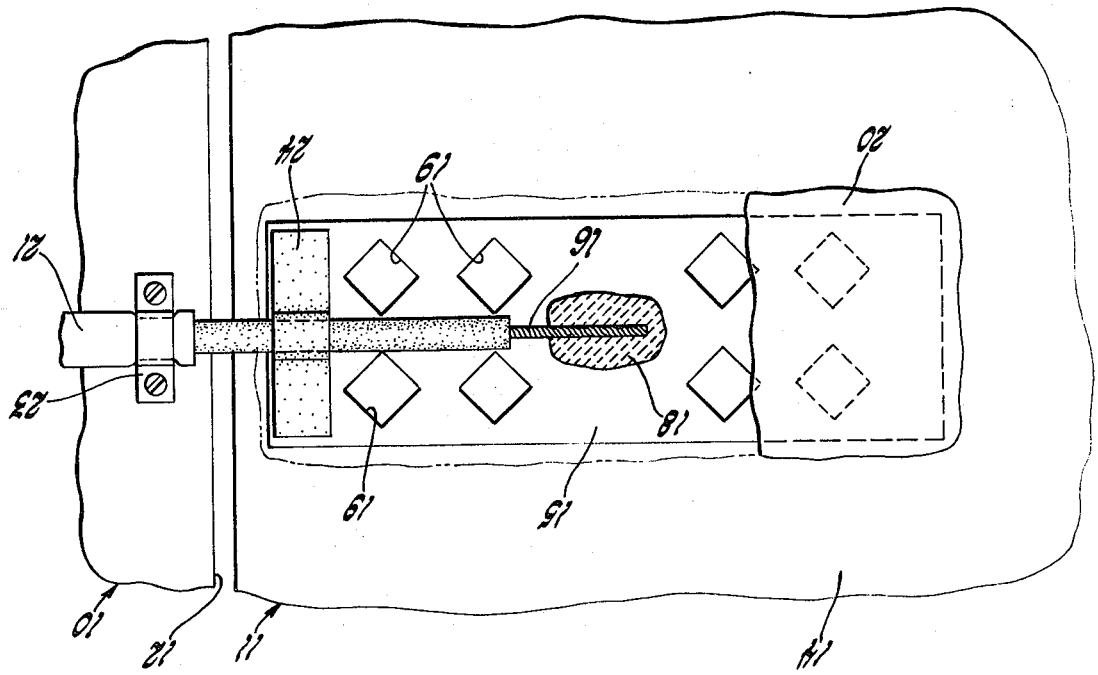
14
15
19
18
16
19
24
20
21
23
10
12
11

ELECTRICALLY CONDUCTING LEAD TERMINATION APPARATUS FOR A THIN FILM ANTENNA

BACKGROUND OF THE INVENTION

This invention relates to apparatus providing an electrically conducting connection between a lead wire or cable and an electrically conducting surface, and more particularly for such apparatus for connecting an antenna lead to a planar conducting member of a slot antenna. Such slot antennas may be useful on motor vehicles, where the sheet metal or sheet material of the vehicle body may be physically divided into separate areas with a slot therebetween, the slot perhaps being bridged by a non-conducting substance to present a smooth, closed vehicle body surface. The antenna lead may be connected directly to the underside of the isolated antenna member by soldering if the antenna member is made of a solderable material such as steel. However, in view of the possibility of the use of non-solderable materials for such antenna members, direct soldering will not necessarily work in all cases. An example of such a material is sheet molding compound, which may be coated with electrically conducting paint for antenna use but will not receive an antenna lead with a direct soldered connection.

SUMMARY OF THE INVENTION

It is therefore an object of this invention to provide apparatus effective to electrically and mechanically connected an antenna lead to a non-solderable, electrically conducting antenna member.

It is a further object of this invention to provide such a connection which maintains low electrical resistance under adverse environmental conditions: particularly high humidity.

The invention, in its broadest form, comprises an electrically conducting antenna member having an electrically conducting, non-solderable surface and a strip of electrically conducting solderable tape fixed adhesively thereto with the lead soldered to the strip. The strip is provided with a plurality of cutout openings to provide inner edges therein; and a coating of electrically conducting paint covers the strip to provide electrical contact between the strip and the surface and further provide environmental protection for the connecting apparatus. If desired, further mechanical anchoring for the lead may be provided.

Further details and advantages of this invention will be apparent from the accompanying FIGURE and following description of the preferred embodiment.

DESCRIPTION OF THE PREFERRED EMBODIMENT

Referring to the FIGURE, a slot antenna comprises first and second electrically conducting, co-planar, sheet-like members 10 and 11 defining a slot 12 therebetween, only portions of which are shown. Antenna elements 10 and 11 are separated physically from each other so that there is no conduction path therebetween, although slot 12 could be physically filled with a non-conducting substance for a smooth surface. It this surface is part of a motor vehicle body, the filled slot can thus be painted over on the outside and hidden.

An antenna lead conductor 16, which may be the central conductor of a coaxial cable or a conductor connected thereto, is to be connected to antenna element 11. Antenna element 11 comprises a non-solderable material such as sheet molding compound coated with a layer 14 of an electrically conducting paint such as Acheson 436 copper shield paint or a similar substance to make it suitable for use as an antenna member.

A strip 15 of solderable, electrically conducting material is applied adhesively directly over the paint coating 14. Copper tape is a suitable, although not the only possible, substance for use as strip 15, since it is electrically conducting and solderable. The antenna lead 16 may be soldered to strip 15 with solder 18. It should be noted that, although the lead 16 is electrically connected with strip 15 directly and/or through the solder 18, strip 15 may not make electrical contact directly over its lower surface to the paint layer 14 because of the adhesive which will probably be an electrically insulating material. Therefore, electrical contact between strip 15 and antenna member 11 must be made through a coating 20 of electrically conductive paint which covers the strip 15 and thus connects the edge and top thereof to antenna member 11.

During the development of this invention, a first developmental embodiment thereof provided the strip 15 attached directly to the surface of the sheet molding compound with a single coating of electrically conductive paint covering the entire antenna member 11 and strip 15. However, during humidity testing, the edges of strip 15 tended to curl up and break the paint coating, which caused the resistance of the connection between conductors 16 and the antenna member 11 to increase substantially. An improvement was seen when the antenna member 11 was coated over its entire surface of sheet molding compound with a first coating of electrically conductive paint, strip 15 was applied over the first coating and a second coating of electrically conductive paint was applied over strip 15. This second developmental embodiment of the invention showed an improvement in resistance readings after humidity testing but was still not completely satisfactory.

A satisfactory embodiment of the invention was finally obtained when a plurality of openings 19 were cut through strip 15 to provide inner edges therefore and additional access to antenna member 11 by conductive paint coating 20. In this embodiment, eight diamond-shaped openings are provided; but many other configurations and numbers can be imagined which will provide similar inner edges and opening area. This embodiment of the invention shows greatly improved resistance readings after humidity testing over either of the developmental embodiments, even though some outer edge curling may be observed. Paint coating 20 provides contact between the top and inner edges of strip 15 and antenna member 11 through openings 19 even if the outer edges of strips 15 curl up and break the paint coating 20 around the outer edge of the strip 15. These results appear to indicate that the inner edges around openings 19 of strip 15 may be inherently less susceptible than outer edges to curling with consequent breakage of the paint coating 20 after exposure to high humidity. However, this superior performance of this embodiment of the invention is supported by testing, regardless of the validity of the aforementioned observation. Paint coating 20 provides electrical contact between the top, inner edges and outer edges of strip 15 and the antenna member 11, both around the outside of strip 15 and through openings 19. In addition, paint coating 20 provides a sealing environmental protection for the apparatus as long as, and in places where, it is not broken by the curling up or edges of the strip 15. Testing has shown that at least the electrical contact made through openings 19 will continue to produce a low resistance for the connection even after exposure to high humidity and other adverse environmental conditions.

The cable 21 of which lead 16 is a part may be physically anchored to antenna element 10 with an electrical connection to member 10 from the shielding conductor by means of a chip 23 or by means of the apparatus shown in the U.S. patent application Ser. No. 049,105 filed by Joseph H. Graeser, Jr., Richard A. Natoli and Robert J. Adkins on the same date as this application and assigned to the same assignee. Additional physical anchoring of lead 16 to antenna member 11 for strain relief may be provided by a strip of tape 24 as shown in the FIGURE.

The embodiment shown and described herein is a preferred embodiment of this invention. However, equivalent embodiments will occur to those skilled in the art; and this invention should therefore be limited only by the following claim.

The embodiments of the invention in which an exclusive property or privilege is claimed are defined as follows:

1. Apparatus for connecting an antenna lead conductor to a non-solderable, electrically conducting antenna member, the apparatus comprising, in combination:

a strip of electrically conducting solderable tape fixed to the antenna member with an adhesive material which may be an insulator, the strip being adapted to receive the lead conductor soldered thereto and provided with one or more cutout openings therethrough, whereby inner edges are provided, the total strip edge length is increased and inner openings to the antenna member are created; and a coating of electrically conducting paint over the strip and cutout openings, the coating providing electrical connection between the strip and the antenna member through the cutout openings and providing environmental protection for the apparatus.

* * * * *